US006279236B1

(12) United States Patent
Brady et al.

(10) Patent No.: US 6,279,236 B1
(45) Date of Patent: Aug. 28, 2001

(54) CAN OPENER

(75) Inventors: Martin Brady, Chesterfield, VA (US); William K. Lee; George Law, both of Kowloon (HK)

(73) Assignees: Hamilton Beach; Proctor-Silex, Inc., both of Glen Allen, VA (US)

( * ) Notice: Subject to any disclaimer, the term of this patent is extended or adjusted under 35 U.S.C. 154(b) by 0 days.

(21) Appl. No.: 09/281,660

(22) Filed: Mar. 30, 1999

Related U.S. Application Data

(60) Provisional application No. 60/080,344, filed on Apr. 1, 1998.

(51) Int. Cl.[7] ..... B67B 7/70
(52) U.S. Cl. ..... 30/410; 30/419; 30/421
(58) Field of Search ..... 30/410–427, 444

(56) References Cited

U.S. PATENT DOCUMENTS

| | | | |
|---|---|---|---|
| D. 362,377 | 9/1995 | Schweizer . | |
| 2,803,057 | 8/1957 | Meader . | |
| 2,879,589 | 3/1959 | Ulke . | |
| 3,178,813 | 4/1965 | Congdon . | |
| 3,487,542 | 1/1970 | Hamwi et al. . | |
| 3,550,271 | 12/1970 | Meyer et al. . | |
| 3,675,321 | 7/1972 | Arel et al. . | |
| 3,689,997 | 9/1972 | McLean . | |
| 3,689,999 | 9/1972 | Swanke et al. . | |
| 3,706,135 * | 12/1972 | Fukunaga et al. | 30/421 X |
| 3,724,069 | 4/1973 | McLean . | |
| 3,757,416 | 9/1973 | Yamamoto . | |
| 3,765,085 | 10/1973 | Ponczek et al. . | |
| 3,772,777 | 11/1973 | Trelc . | |
| 3,911,571 | 10/1975 | Ponczek et al. . | |
| 3,927,472 | 12/1975 | Yamamoto . | |
| 4,534,108 | 8/1985 | Yamamoto et al. . | |
| 5,313,708 | 5/1994 | Edwards et al. . | |

OTHER PUBLICATIONS

Copy of Use and Care Manual for Sunbeam "Pop & Clean" Under–the–Counter Can Opener, published 1994.
Copy of Use and Care Manual for Sunbeam "Pop & Clean" Extra Tall Can Opener, Publication date unknown.
See Information Disclosure Statement discussing References AR and AS.

* cited by examiner

*Primary Examiner*—Douglas D. Watts
(74) *Attorney, Agent, or Firm*—Roger S. Dybvig

(57) ABSTRACT

A household electric can opener operable by vertical movements of a control button. The can opener has an easily removable assembly that includes all of the exposed operating parts, including a cutting blade, a can drive wheel, the control button, and a lid magnet assembly. The entire removable cutter assembly is water immersible or machine washable for improved sanitation.

11 Claims, 5 Drawing Sheets

CAN OPENER

CROSS REFERENCE TO RELATED APPLICATIONS

This application claims the benefit of U.S. Provisional Application No. 60/080,344, filed on Apr. 1, 1998.

FIELD OF THE INVENTION

This invention relates to electric motor driven can openers for household use.

BACKGROUND OF THE INVENTION

The drive wheels and cutting blades of can openers are difficult to clean. Therefore, some can openers have removable assemblies which include parts of the can opener which can be removed and safely immersed in water or cleaned in a dish washer without involving any electrical components.

Another problem with many can openers of today is that they are made for use by right-handed persons and are difficult for left-handed persons to operate efficiently. Left-handed persons must either learn how to operate these appliances as a right-handed person or buy a left-handed appliance which may not exist or may be quite expensive.

SUMMARY OF THE INVENTION

This invention provides a can opener that has a removable assembly which includes all of the exposed operating parts of the can opener.

This invention also provides a can opener controlled by a central operating button which is easily usable by both right and left handed individuals. Furthermore, the operating button moves only vertically and is therefore easy for essentially anyone to operate.

Other objects and advantages will become apparent from the following description and the drawings.

DETAILED DESCRIPTION

Figure 1:
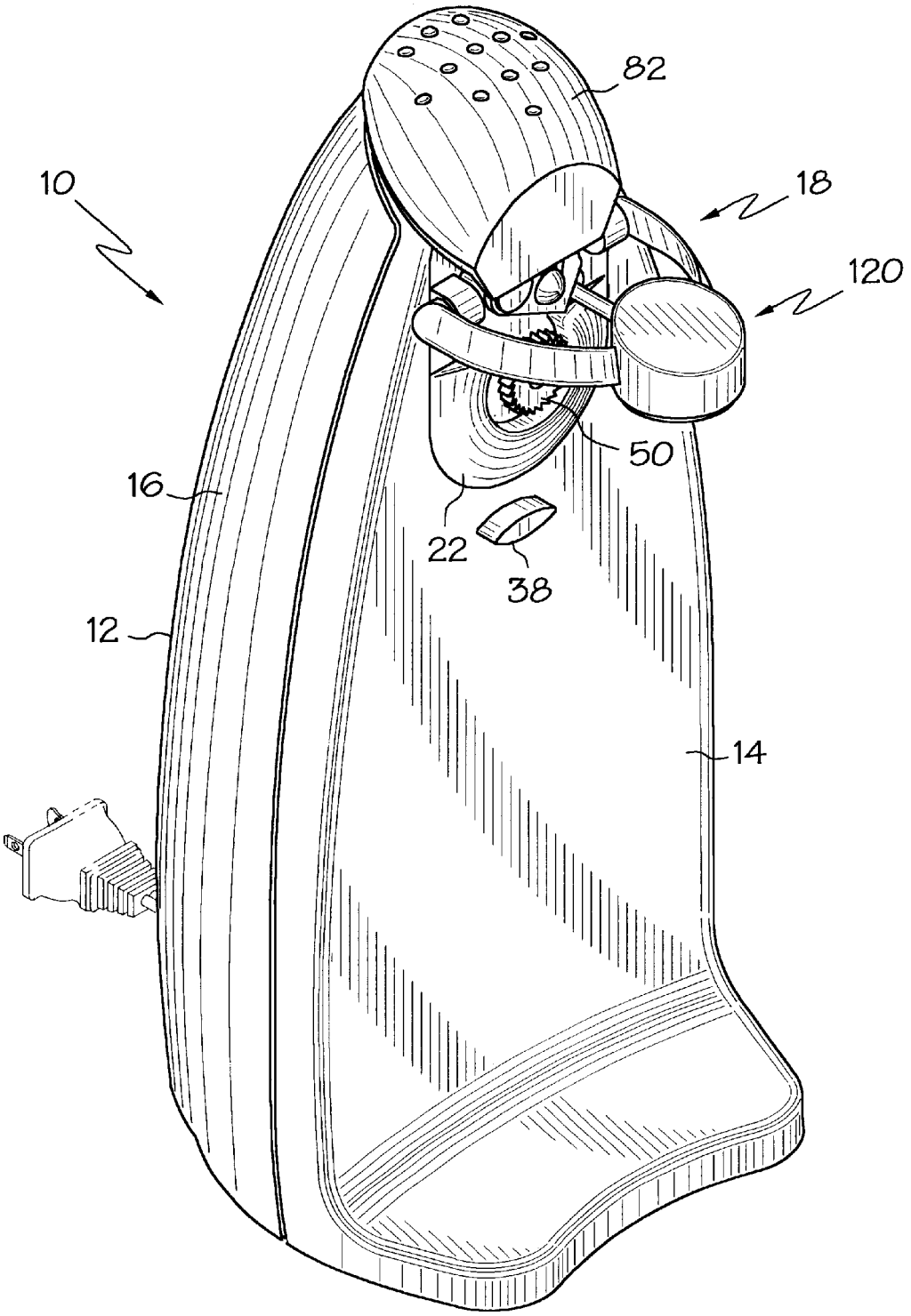
FIG. 1 is a perspective view of a can opener in accordance with this invention.
Figure 2:
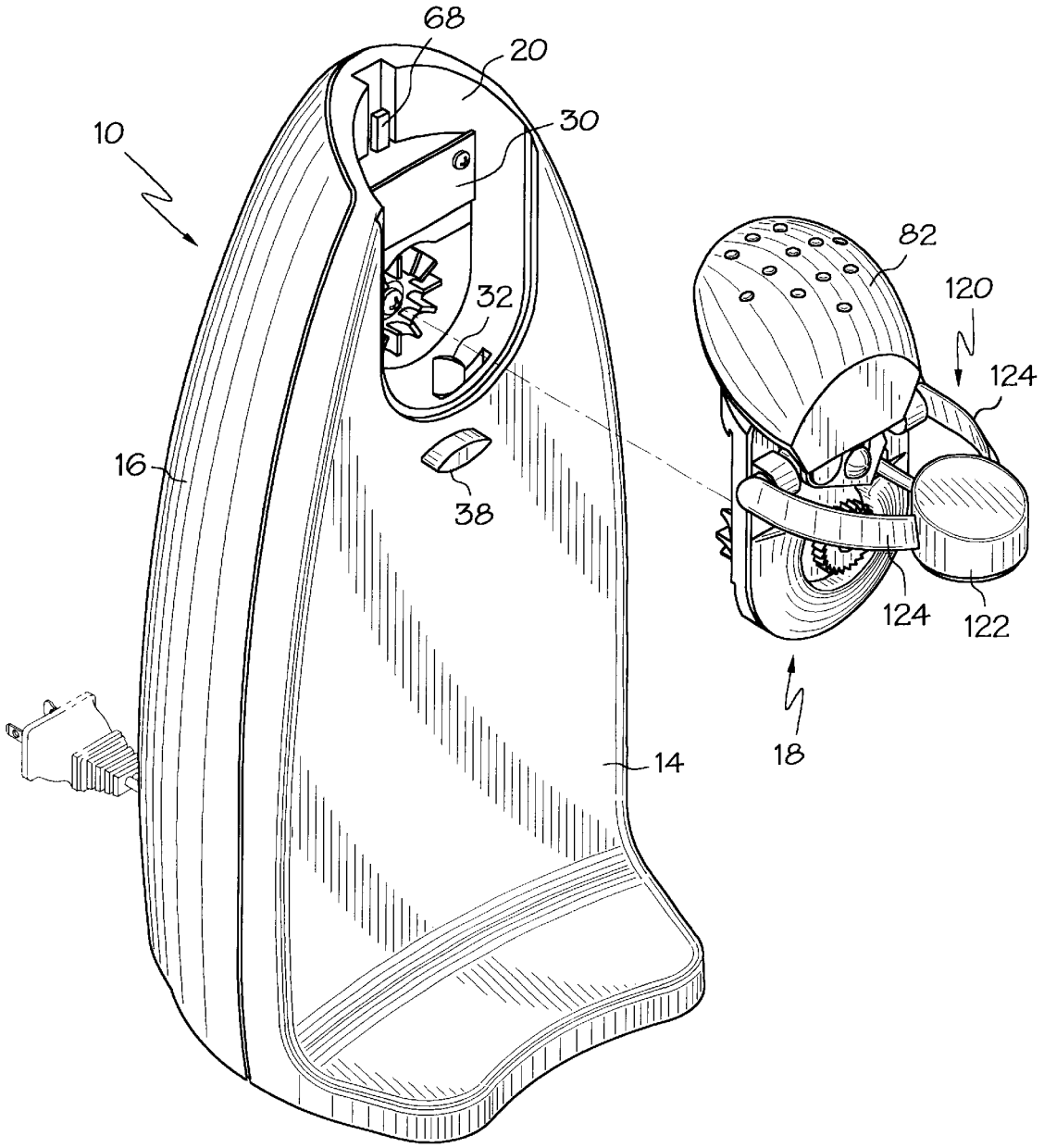
FIG. 2 is a perspective view similar to FIG. 1 but showing the removable assembly exploded away from the opener housing.

With reference to FIGS. 1 and 2, this invention is shown embodied in a can opener 10, comprising a motor housing 12 formed from a front housing section 14 and a rear housing section 16, which may be connected together by connecting screws or the like (not shown). In addition, the can opener 10 includes a removable support assembly 18 that supports operating parts of the can opener 10 as will be further described below.

Figure 3:
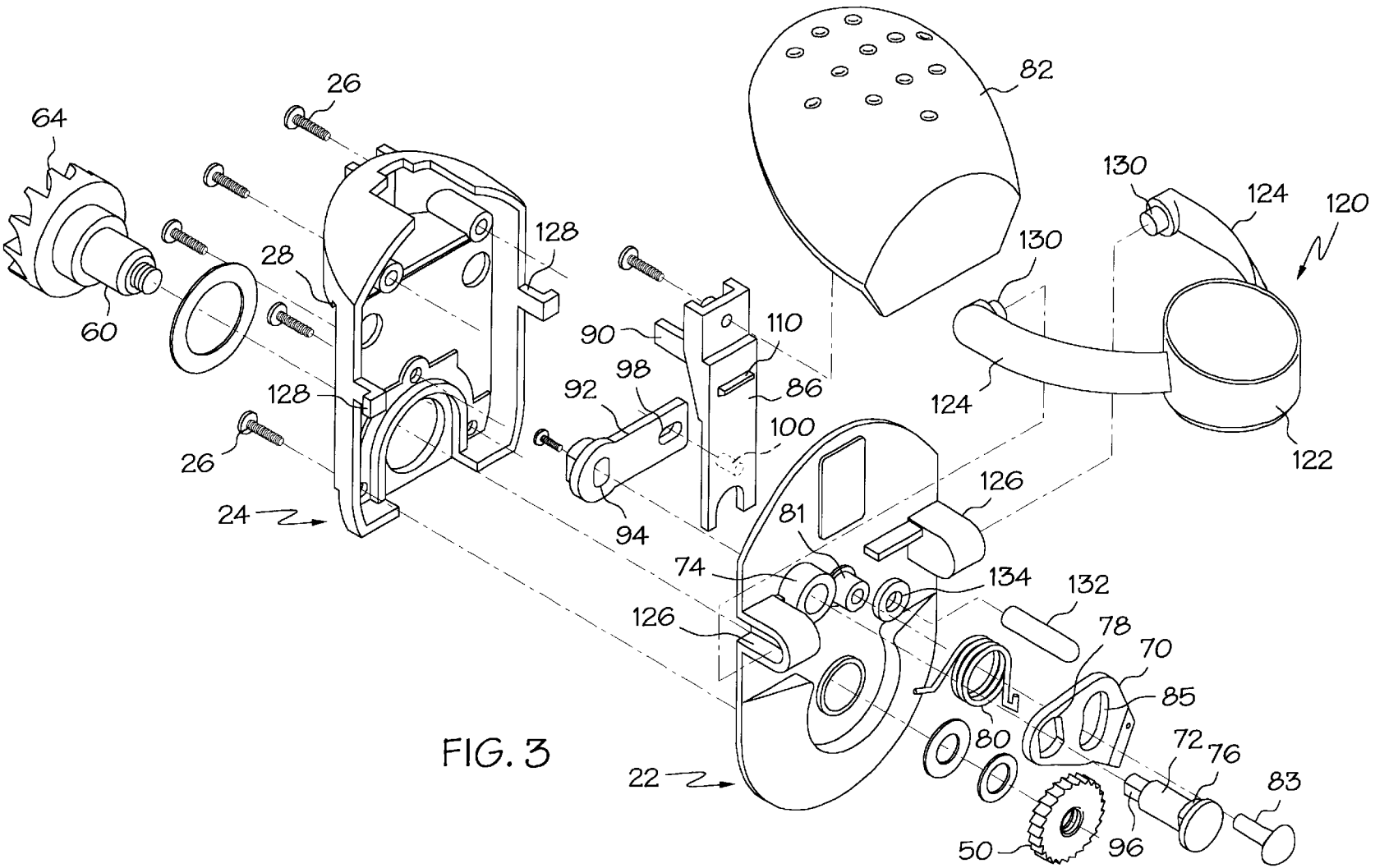
FIG. 3 is an exploded perspective view of the removable assembly.
Figure 5:
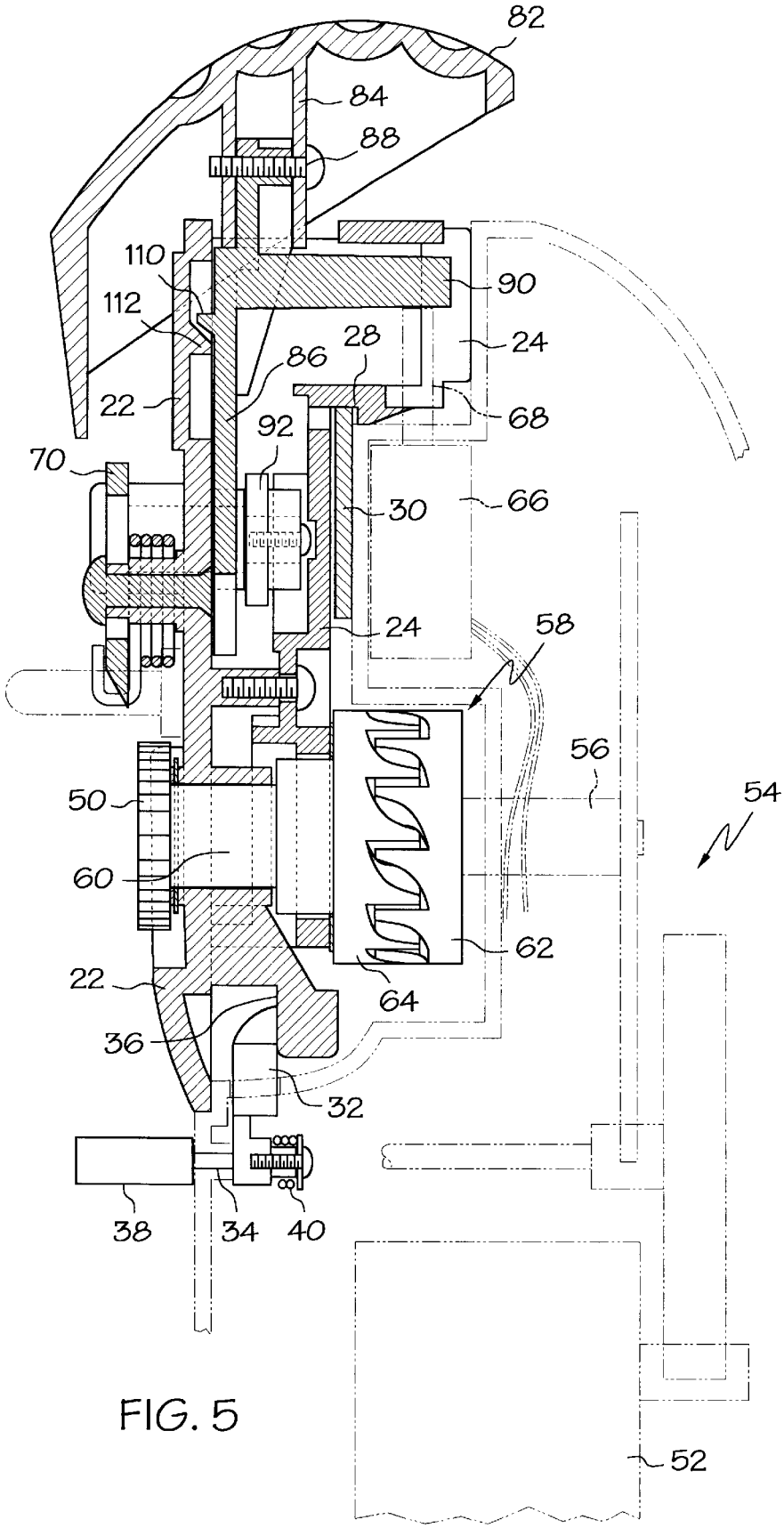
FIG. 5 is cross-sectional view of the can opener taken along section line 5—5 of FIG. 4.

With reference also to FIGS. 3 and 5, in the preferred embodiment of this invention, the upper end of the front housing section 14 has a cavity 20 that receives part of the support assembly 18. The support assembly 18 has a front support member 22 and a rear support member 24 which may be connected together by several self-tapping screws 26 or the like. The support assembly 18 is suspended from the motor housing 12 by means of downwardly-facing channel 28 formed along the upper rear portion of the rear support member 24 that engages over the top of a vertical mounting plate 30 connected to the front housing section 14 and located within the cavity 20. A rotatable clamp piece 32 connected to a mounting shaft 34 rotatably supported by the front housing section 14 is engageable with a forwardly-facing surface 36 formed on the support assembly 18 to hold the lower end of the support assembly 18 within the bottom of the cavity 20. A user engageable release knob 38 extends out of the front face of the housing 12 and may be manually rotated to pivot the clamp piece 32 to an out-of-the-way position to permit the lower end of the support assembly 18 to be moved away from the housing 12 so that the support assembly 18 and the operating parts mounted thereon may be lifted off the mounting plate 30 and removed in one piece for cleaning or other purposes. Suitable spring means, such as the coil spring 40 partly illustrated in FIG. 5, are preferably provided to bias the clamp piece 32 into its vertical orientation illustrated in the drawings.

Figure 4:
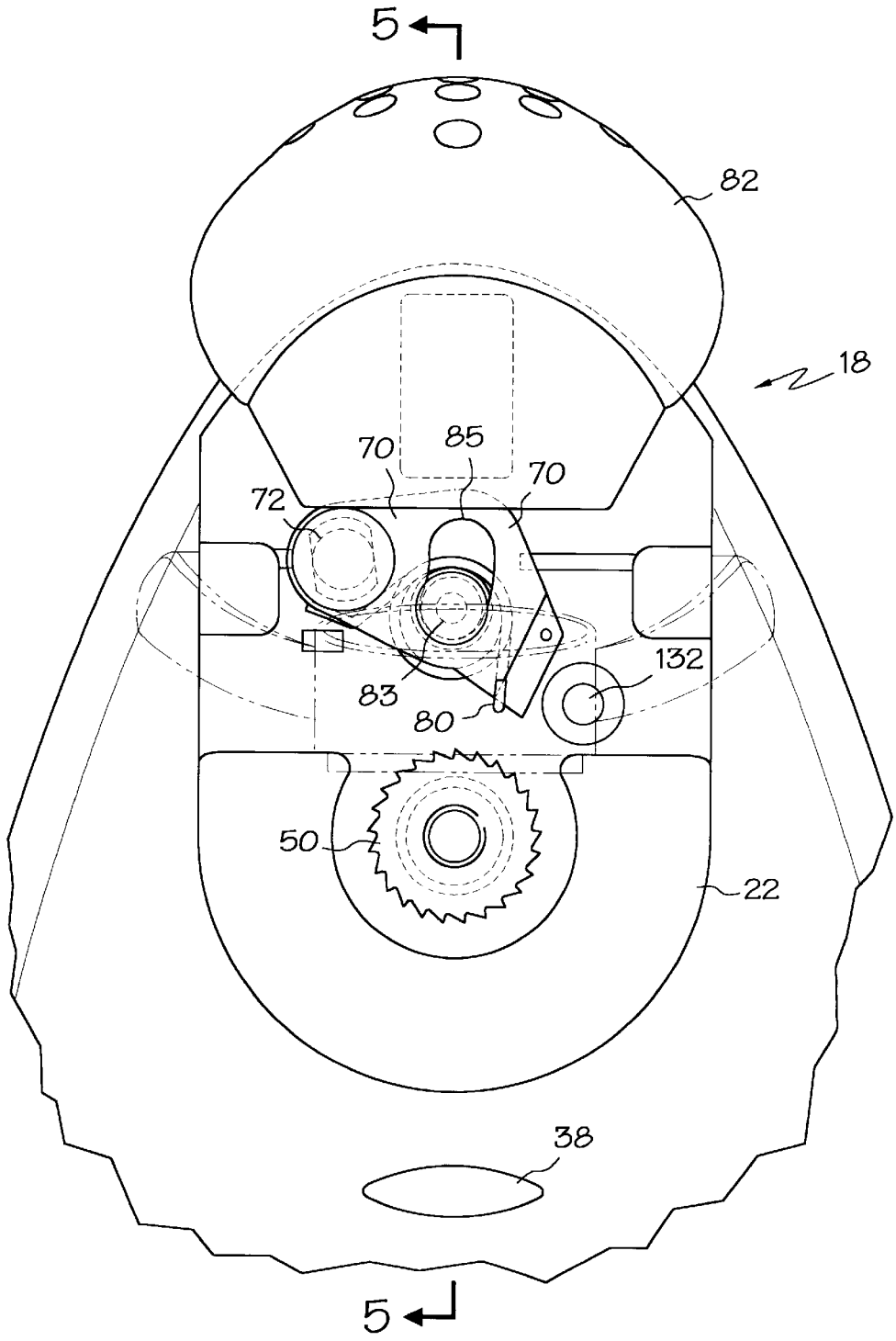
FIG. 4 is an enlarged, fragmentary front elevational view of the upper portion of the can opener.

With reference also to FIGS. 3, 4 and 5, the can opener 10 includes a can drive wheel 50 rotatable with respect to the motor housing 12 about an axis extending through the motor housing 12. An electric drive motor 52 and a suitable gear drive train 54 are mounted in the motor housing 12 and drivingly connected to the can drive wheel 50. To this end, the gear drive train 54 is drivingly connected to a drive shaft 56, a clutch 58, and a driven shaft 60 on which the can drive wheel 50 is mounted. The clutch 58 includes a toothed, drive clutch member 62 affixed to the forward end of the drive shaft 56 and a toothed, driven clutch member 64 affixed to the rearward end of the driven shaft 60. The clutch members 62 and 64 intermesh with one another when the removable assembly 18 is clamped to the housing 10 but are readily separated when the removable assembly 18 is removed.

Operation of the drive motor 52 is controlled by a drive motor-control switch 66 having a switch-operating member 68. The electrical circuitry used to control the operation of the drive motor 52 may be entirely conventional and forms no part of the present invention.

Referring to FIGS. 3, 4 and 5, a can-opening blade 70 is mounted on a blade-mounting shaft 72 that extends through a bearing 74 formed as part of the front support member 22 for pivotal movement or rotation about an axis parallel to the axis of rotation of the can drive wheel 50. As can be seen in FIG. 3, the blade mounting shaft 72 has a non-circular section 76 that mates with a non-circular aperture 78 in the blade 70 so that rotation of the blade 70 is imparted to its mounting shaft 72, and vice versa. This permits a pivotal movement of the blade 70 from a first, retracted, position in which the blade 70 is remote from a can (not shown) having a rim supported by the drive wheel 50 to a second, extended, position in which the blade 70 pierces the lid of a can supported by the drive wheel 50. A blade spring 80 coiled about a tubular boss 81 on the front face of the first support member 22 biases the blade 70 to its retracted position away from engagement with a can (not shown) supported by the drive wheel 50. A rivet 83 that projects through an arcuate slot 85 in the blade 70 maintains the vertical orientation of the blade 70.

A user may initiate operation of the can opener 10 by depressing a knob-like control button 82 that has a vertical stem 84 (FIG. 5) substantially confined for movement along a vertical path by adjacent surfaces of the support assembly 18. The upper end of a master member 86 is fixedly connected to the button stem 84, as by a screw 88, and therefore moves in the same vertical directions as the control button 82. The master member 86 is also substantially confined for movement along a vertical path by ribs (not shown) that project rearwardly from the rear surface of the front support member 22. As shown in FIGS. 3 and 5, the master member 86 has a horizontally-extending switch operating arm 90 engageable with the switch-operating member 68. Thus, when a user depresses the control button 82, the drive motor 52 is energized to initiate rotation of the drive wheel 50.

The master member 86 is connected to the blade mounting shaft 72 by a connecting link 92 having a non-circular bore 94 that mates with a non-circular surface 96 at the rearward end of the blade mounting shaft 72 so that the pivotal motion of the connecting link 92 is imparted to the blade mounting shaft 72 and vice versa. (The non-circular parts of the shaft 72 can be of the common "double D" configuration.)

The opposite end of the connecting link 92 has an elongate slot 98 that receives a drive pin 100 projecting rearwardly from the rear face of the master member 86. Accordingly, vertical movements of the master member 86 cause pivotal movements of the connecting link 92, and vice versa. As is evident, when the control button 82 is depressed by a user, the master member 86 moves downwardly and causes the connecting link 92, the blade mounting shaft 72, and the blade 70 to rotate in a clockwise direction as viewed in the drawings, to cause the blade 70 to engage the lid of a can supported by the drive wheel 50. As well known in the art, the essentially coincident energization of the drive motor 52 imparts a force exerted in a clockwise direction against the blade 70, causing the blade 70 to pierce the can lid. The force exerted by the can lid is maintained until the lid is cut free from the body of the can, at which time the force exerted on the blade 70 by the rotating can ceases. At such time, the blade spring 80 causes the blade 70 to reversely rotate, in a counterclockwise direction as viewed in the drawings, with consequent raising of the master member 86, at which time the switch operating arm 90 moves upwardly by a distance sufficient to open the drive motor control switch 66.

So that one may initiate a cutting operation without having to hold onto a can, the can is supported with its rim confined between the drive wheel 50, from which it derives support, and the blade 70. Further in accordance with this invention, the blade 70 will not raise so far after a can lid is completely cut away from a can body to release the grip on the can rim by the blade 70 and the drive wheel 50. Instead, the upward return, i.e., counterclockwise, motion of the blade 70 is limited by the engagement of the top surface of a first, vertically-movable, horizontal ledge 110 projecting forwardly from the front face of the master member 86 with a bottom surface of a second horizontal, stop ledge 112 (FIG. 5) projecting rearwardly from the rear surface of the front support member 22. In FIG. 5, which shows the parts when the can opener 10 is not operating, the moving first horizontal ledge 110 on the master member 86 is located above the second, stop ledge 112 on the front support member 22. There it will noted that the confronting surfaces of the two ledges 110 and 112 are correspondingly sloped so that, when the control button 82 is depressed, the first ledge 110 readily cams around and under the second ledge 112. The camming of the first ledge 110 rearwardly is made possible because the master member 86 which is made from a suitable plastic material, such as ABS, can flex along its length sufficiently to permit the rearward movement of the first ledge 110. After the cutting of a can lid is completed, it will be evident that the flat upper surface of the first, moving ledge 110 will be positively stopped by the flat lower surface of the second, stop ledge 112. In order to release a can from the grip of the blade 70 and the drive wheel 50, a user may grasp the can in one hand and push rearwardly on the control button 82 with the other hand to push the top of the master member 86 rearwardly so that its ledge 110 is removed from engagement with the stop ledge 112, thereby enabling the blade spring 80 to drive the blade 70 counterclockwise to its fully retracted position. As a consequence, the control button 82 is returned to its uppermost position in readiness to be depressed to open another can.

Another feature of the can opener 10 of this invention is that a lid magnet assembly 120 is mounted on the removable support assembly 18. The lid magnet assembly 120 comprises a magnet housing 122 and a pair of magnet support arms 124 extending arcuately from said magnet housing 122. The space between the arms 124 is substantially open to enable a user to directly view the cutter blade and drive wheel area by looking between said magnet support arms 124. With reference to FIG. 3, the front support member 22 has oppositely facing channels 126 that cooperate with forwardly projecting fingers 128 on the rear support member 24 to form sockets that confine cylindrical bosses 130 at the free ends of the magnet support arms 124 to permit the magnet housing 122 to be raised and lowered by pivotal movements about the axis extending centrally through the bosses 130. The removable assembly 18 also supports a can guide pin 132 which may be press fit within a bore 134 in the front support member 22.

The motor housing 12 and many other parts of the can opener 10 may be made from suitable plastic materials. The front and rear support members 22 and 24 may be made from a glass-filled nylon material. The master member 86 and the control button 82 may be made from ABS. The connecting link 92 may be made from nylon.

Although the presently preferred embodiments of this invention have been described, it will be understood that within the purview of the invention various changes may be made within the scope of the following claims.

Having thus described our invention, we claim:

1. A can opener comprising:

a motor housing;

a can drive wheel rotatable with respect to said motor housing about an axis extending through said motor housing;

an electric drive motor mounted in said motor housing and connected to said can drive wheel;

a drive motor-control switch;

a can-opening blade pivotally mounted on said motor housing for pivotal movement about an axis parallel to the axis of rotation of said drive wheel from a first position in which said blade is remote from a can having a rim supported by the drive wheel to a second position in which said blade pierces the lid of a can supported by said drive wheel;

a blade spring biasing said blade into said first position;

an operating member movable alona a linear path between a first position and a second position, said operating member having a switch operating arm engageable with said drive motor control switch to energize the drive motor as said operating member is moved from its said first position to its said second position;

a motion transmitting assembly connecting said operating member to said blade that causes said blade to move into engagement with the lid of a can supported by said drive wheel as said operating member moves from its said first position toward its said second position to energize said drive motor so that said blade is engaged with the lid of said can supported by said drive wheel and caused to Pierce said can lid due to the rotation of said can by said drive wheel;

a manually operable control button connected to said operating member for substantially linear movement therewith which a user may depress to initiate operation of said drive motor;

said blade spring reversely pivoting said blade when the cutting of said can is completed and driving said operating member toward its first position to thereby open said drive motor control switch;

said blade and said drive wheel confining the rim of a can therebetween when the can opener is in operation; and means for interrupting return movement of said blade after a lid has been cut away from a can for the purpose of continuing to confine the can rim until the user of the can opener decides to remove the can.

2. The can opener of claim 1 wherein said means for interrupting return movement of said blade comprises a ledge on said operating member and a stop member which is fixed relative to said motor housing.

3. A can opener comprising:

a motor housing;

a can drive wheel rotatable with respect to said motor housing about an axis extending through said motor housing;

an electric drive motor mounted in said motor housing and connected to said can drive wheel;

a drive motor-control switch;

a can-opening blade pivotally mounted on said motor housing for pivotal movement about an axis parallel to the axis of rotation of said drive wheel from a first position in which said blade is remote from a can having a rim supported by the drive wheel to a second position in which said blade pierces the lid of a can supported by said drive wheel;

a blade spring biasing said blade into said first position;

an operating member movable alona a linear path between a first position and a second position, said operating member having a switch operating arm engageable with said drive motor control switch to energize the drive motor as said operating member is moved from its said first position to its said second position;

a motion transmitting assembly connecting said operating member to said blade that causes said blade to move into engagement with the lid of a can supported by said drive wheel as said operating member moves from its said first position toward its said second position to energize said drive motor so that said blade is engaged with the lid of said can supported by said drive wheel and caused to pierce said can lid due to the rotation of said can by said drive wheel;

a manually operable control button connected to said operating member for substantially linear movement therewith which a user may depress to initiate operation of said drive motor;

said blade spring reversely Divoting said blade when the cutting of said can is completed and driving said operating member toward its first position to thereby open said drive motor control switch, said blade and said drive wheel confine the rim of a can therebetween when the can opener is in operation and said opener further comprising:

a stop member fixed in relation to said motor housing;

a ledae on said operating member which engages said stop member for interrupting return movement of said blade after a lid has been cut away from a can for the PurDose of continuing to confine the can rim until the user of the can oDener decides to remove the can, said operating member being constructed and arranged to enable said ledge to be moved out of engagement with said stop member by movement of said control button.

4. The can opener of claim 3 wherein said operating member is flexed along its length to cause said ledge to move past said stop member in both directions of movement of said operating member.

5. A can opener comprising:

a motor housing;

a can drive wheel rotatable with respect to said motor housing about an axis extending through said motor housing;

an electric drive motor mounted in said motor housing and connected to said can drive wheel;

a drive motor-control switch;

a can-opening blade pivotally mounted on said motor housing for pivotal movement about an axis parallel to the axis of rotation of said drive wheel from a first position in which said blade is remote from a can having a rim supported by the drive wheel to a second position in which said blade pierces the lid of a can supported by said drive wheel;

a blade spring biasing said blade into said first position;

an operating member movable along a linear path between a first position and a second position, said operating member having a switch operating arm engageable with said drive motor control switch to energize the drive motor as said operating member is moved from its said first position to its said second position;

a motion transmitting assembly connecting said operating member to said blade that causes said blade to move into engagement with the lid of a can supported by said drive wheel as said operating member moves from its said first position toward its said second position to energize said drive motor so that said blade is engaged with the lid of said can supported by said drive wheel and caused to pierce said can lid due to the rotation of said can by said drive wheel; and a manually operable control button connected to said operating member for substantially linear movement therewith which a user may depress to initiate operation of said drive motor;

said blade spring reversely pivoting said blade when the cutting of said can is completed and driving said operating member toward its first position to thereby open said drive motor control switch; and said motion transmitting assembly comprising a blade-mounting shaft connected to said blade for pivotal movement therewith and a drive link connecting said shaft to said operating member so that substantially linear movement of said operating member causes pivotal movement of said blade.

6. A can opener comprising:

a motor housing;

a can drive wheel rotatable with respect to said motor housing about an axis extending through said motor housing;

an electric drive motor mounted in said motor housing and connected to said can drive wheel;

a drive motor-control switch;

a can-opening blade pivotally mounted on said motor housing for pivotal movement about an axis parallel to the axis of rotation of said drive wheel from a first position in which said blade is remote from a can having a rim supported by the drive wheel to a second position in which said blade pierces the lid of a can supported by said drive wheel;

a blade spring biasing said blade into said first position;

an operating member movable along a linear path between a first position and a second position, said operating member having a switch operating arm engageable with said drive motor control switch to energize the drive motor as said operating member is moved from its said first position to its said second position;

a motion transmitting assembly connecting said operating member to said blade that causes said blade to move into engagement with the lid of a can supported by said drive wheel as said operating member moves from its said first position toward its said second position to energize said drive motor so that said blade is engaged with the lid of said can supported bv said drive wheel and caused to pierce said can lid due to the rotation of said can by said drive wheel; and a manually operable control button connected to said operating member for substantially linear movement therewith which a user mav depress to initiate operation of said drive motor;

said blade spring reversely pivoting said blade when the cutting of said can is completed and driving said operating member toward its first position to thereby open said drive motor control switch; and said drive wheel being connected to said drive motor by a driven shaft, a drive shaft and a clutch connecting said driven shaft to said drive shaft, said clutch comprising a pair of mutually-engageable and separable clutch members connected, respectively, to said drive shaft and to said driven shaft.

7. A can opener comprising:

a motor housing;

a can drive wheel rotatable with respect to said motor housing about an axis extending through said motor housing;

an electric drive motor mounted in said motor housing and connected to said can drive wheel;

a drive motor-control switch;

a can-opening blade pivotally mounted on said motor housing for pivotal movement about an axis parallel to the axis of rotation of said drive wheel from a first position in which said blade is remote from a can having a rim supported by the drive wheel to a second position in which said blade pierces the lid of a can supported by said drive wheel;

a blade spring biasing said blade into said first position;

an operating member movable alona a linear path between a first position and a second position, said operating member having a switch operating arm engageable with said drive motor control switch to energize the drive motor as said operating member is moved from its said first position to its said second position;

a motion transmitting assembly connecting said operating member to said blade that causes said blade to move into engagement with the lid of a can supported by said drive wheel as said operating member moves from its said first position toward its said second position to energize said drive motor so that said blade is engaged with the lid of said can supported by said drive wheel and caused to pierce said can lid due to the rotation of said can by said drive wheel;

a manually operable control button connected to said operating member for substantially linear movement therewith which a user may depress to initiate operation of said drive motor;

said blade spring reversely pivoting said blade when the cutting of said can is completed and driving said operating member toward its first position to thereby open said drive motor control switch said drive wheel being connected to said drive motor by a driven shaft, a drive shaft and a clutch connecting said driven shaft to said drive shaft, said clutch comprising a pair of mutually-engageable and separable clutch members connected, respectively, to said drive shaft and to said driven shaft, and further comprising a support assembly removably connected to said motor housing that supports said driven shaft, said can drive wheel, said can-opening blade, said blade spring, said operating member, said motion transmitting assembly, and said control button.

8. The can opener of claim 7 wherein said removable support assembly has an upper end portion suspended from said motor housing and a lower end portion releasably clamped to said motor housing.

9. The can opener of claim 8 wherein said lower end portion has a clamp surface facing outwardly from said motor housing and is releasably clamped to said motor housing by a clamping member engageable with said clamp surface, said clamping member being rotatably mounted on said motor housing and said can opener further comprising a rotatable clamp release knob extending from said motor housing and connected to said clamping member by which said clamping member may be rotated to remove said clamping member from engagement with said support assembly.

10. The can opener of claim 8 further comprising a lid magnet assembly mounted on said removable support assembly.

11. The can opener of claim 10 wherein said lid magnet assembly comprises a magnet housing and a pair of magnet support arms extending arcuately from said magnet housing with the space between said arms being substantially open to enable a user to directly view the cutter blade and drive wheel area by looking between said magnet support arms.

* * * * *